United States Patent [19]

Frappier

[11] 4,022,116

[45] May 10, 1977

[54] METHOD AND APPARATUS FOR FOLDING BOX FLAPS

[75] Inventor: Robert H. Frappier, Southwick, Mass.

[73] Assignee: International Paper Company, New York, N.Y.

[22] Filed: July 14, 1975

[21] Appl. No.: 595,863

[52] U.S. Cl. ..... 93/51 M; 93/49 M; 93/51 HW

[51] Int. Cl.[2] ..... B31B 9/26

[58] Field of Search ..... 93/51 HW, 51 R, 59 R, 93/59 CE, 49 R, 47, 36 R, 51 M, 36.3, 36 MM; 53/374, 383

[56] References Cited

UNITED STATES PATENTS

| | | | |
|---|---|---|---|
| 1,400,292 | 12/1921 | Joslin | 93/47 |
| 2,741,957 | 4/1956 | Haas | 93/51 HW |
| 2,820,403 | 1/1958 | Plough et al. | 93/51 HW |
| 2,930,294 | 3/1960 | Ritscher | 93/51 R |
| 2,957,395 | 10/1960 | Meyer | 93/49 R |
| 3,077,064 | 2/1963 | Russell | 53/383 X |

*Primary Examiner*—James F. Coan
*Attorney, Agent, or Firm*—Alfred L. Michaelsen

[57] ABSTRACT

A method and apparatus wherein a pair of generally upwardly extending flaps, foldably connected to the opposite walls of an open top box, may be folded and positioned within the box.

14 Claims, 6 Drawing Figures

METHOD AND APPARATUS FOR FOLDING BOX FLAPS

BACKGROUND OF THE INVENTION

Frequently, manufacturers of corrugated paperboard boxes are caled on to supply boxes wherein an opposed pair of walls are comprised of two plies. For example, a box of this construction may be required in order to provide high stacking strength whereby a number of filled boxes may be stacked, one upon the other.

Whatever the reasons which necessitate such a box construction, the initial user of such a box is faced with the difficulty of quickly and efficiently assembling the box from an initially flat blank. In general, the desirability of providing a machine for automatically assembling a box from a flat blank has been recognized by the prior art relating to box making machinery. Illustrative of the prior art in this regard are U.S. Pat. Nos. 2,921,506, 1,287,032, 2,846,929 3,065,679, 2,132,859, 2,371,046, 3,741,084, 2,196,440, 2,741,957 and 3,125,007. Although all these patents disclose box making machinery, it will be seen upon close inspection that the machines diclosed in each of these patents tend to become more complex when the machine has to perform the function of forming a box having a double ply wall. Part of the complexity reflected by the machines disclosed in these patents is, perhaps, attributable to the typical prior art approach of endeavoring to substantially simultaneously form a box and form box walls which have a double ply.

Another complicating factor, which may not be evident from a review of these patents, is the machine design difficulty which arises when it is required to provide a machine for forming a box having double ply walls and wherein the depth of the box is substantial and the interior or reinforcing plies of the box extend over the entire height of the box. As may be evident upon some relection, it becomes increasingly difficult to automatically form a box having double ply walls when the box has a significant depth and the interior ply extends over the entire height of the box.

The prior art patents identified above are particularly instructive to the extent that they appear to reflect a failure by the prior art to conceive of a machine having the specialized function of folding only the box flaps wich ultimately form the interior reinforcing plies of a box having two ply walls. Thus, one attribute of my invention is that, in the preferred embodiment thereof, a machine is provided which is particularly adapted to the task of forming a box of the type heretofore described wherein the machine is initially supplied with a formed, open top box having upwardly extending flaps.

The utility of my invention is particularly evident with respect to a box construction wherein opposed walls have a two ply thickness and the interior or reinforcing plies are disposed in planes which are downwardly and outwardly inclined (anticlinal) and wherein there is a flat panel section connecting the top edges of respective pairs of wall plies. Typically, prior art machines lacked the capability of automatically erecting such a box, i.e., prior art machines generally have been designed to erect a more simple box construction wherein any interior reinforcing plies are vertically disposed and are positioned adjacent to the exterior side walls. One of the difficulties encountered in erecting a box construction of the former type is that each interior or reinforcing ply must be rotated through an angle greater than 180°. Essentially, this constraint forecloses the use of such simple machine design expedients as pivotally mounted folding arms, i.e., it is generally difficult to employ a folding arms in a manner which will result in the rotation of a flap through an angle greater than 180°.

As hereinafter will be apparent, my invention is characterized by a relatively simple but efficient machine for accepting an open top box having upwardly extending flaps and folding or positioning the flaps within the box so as to provide reinforcing plies. Because of the capabilities of a machine embodying my invention, no substantial problem is presented when the reinforcing flaps of a deep box are substantially equal to the height of a box or if such flaps have to be folded through an angle greater than 180°.

SUMMARY OF THE INVENTION

An apparatus for folding flaps which extend generally upwardly from opposite sides of an open top box. The apparatus includes flap folding means preferably in the form of flap folding shoulders secured to folding arms which are horizontally and vertically movable. Preferably, the flap folding means are movably mounted on a vertically reciprocable mandrel and are disposed below the mandrel.

The flap folding means are disposed in a forming station and means are provided for lonitudinally displacing a box into the forming station. Preferably, means are also provided for depositing an adhesive on the interior of the upwardly extending flap, adjacent to their terminal edge, when the box is moved into the forming station. In addition, in a preferred form of my invention, a plurality of rollers are longitudinally disposed within the machine and are rotated so as to provide a means for transversely discharging a box from the machine.

When practicing a method which utilizes my invention, inwardly directed forces are initially applied to the two upwardly extending flaps, thus partially folding the flaps toward each other. Thereafter, substantially vertically directed forces are applied to the flaps whereby each of the flaps is applied downwardly and into the box. Thereafter, outwardly directed forces may be applied to the flaps so as to position the lowermost portion of each flap adjacent to a respective side wall. One characteristic of a method embodying my invention is the folding of a flap, into a box, wherein said folding step results in the rotation of said flap through an angle greater than 180°.

DESCRIPTION OF PREFERRED EMBODIMENT

Figure 1:
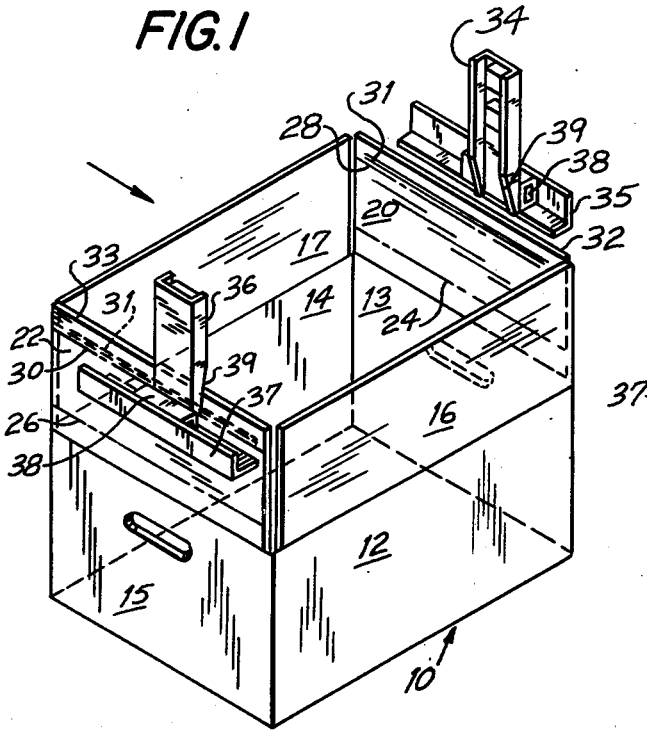
FIGS. 1–5 are perspective views of a box being formed by a method and apparatus embodying my invention.

Referring to FIG. 1, there is shown an open top box generally designated by the reference number 10. The box 10 includes side walls 13, 15 and end walls 12, 14. Of course, it is to be understood that as used herein, the words "side" and "end" are used in a relative sense to designate oppositely disposed walls. Extending generally upwardly from the side walls 13 and 15 are flaps 20, 22, respectively. For purposes of designation only, the flaps 20, 22 are sometimes hereinafter referred to as the reinforcing flaps. The box 10 may also be provided with flaps 16, 17 which are foldably connected to end walls 12, 14, respectively. The flaps 16, 17 may be employed as closure flaps to seal the box 10 after it has been more fully formed and articles package therein.

The box 10 reflects a construction which may be desirable from the point of view of a user of the box and also demonstrates the utility of a preferred form of my invention. Thus, the reinforcing flaps 20, 22 are provided with score lines 24, 26, respectively, and score lines 28, 30, respectively. In addition, a quantity of adhesive 31 may be deposited on the interior surface of the flaps 20, 22, adjacent the terminal edges 32, 33, as shown in FIG. 1.

Figure 2:
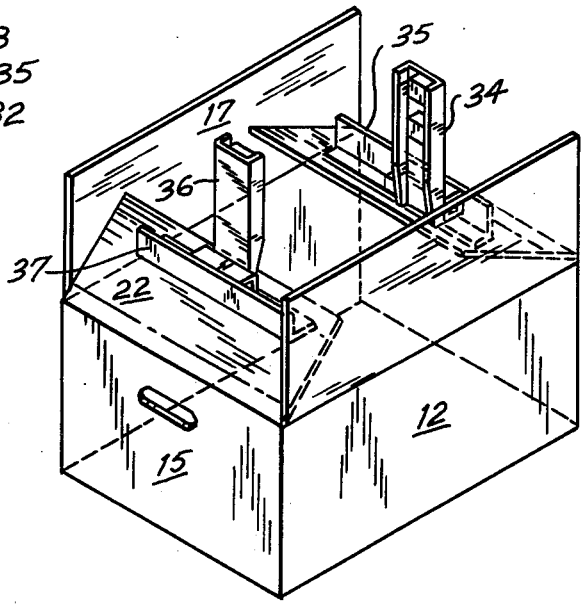

As shown in FIG. 2, the first step in the practice of a process which embodies my invention, is the application of inwardly directed forces to the flaps 20, 22. As a result of the application of such forces, the flaps 20, 22 are folded inwardly and toward each other. In the preferred form of my apparatus, such inwardly directed forces are applied by a pair of flap folding arms 34, 36. Hereinafter, the construction of an apparatus embodying my invention is more fully set forth. Thus, at this point, suffice it to say that the flap folding arms 34, 36 are movable along a path which is perpendicular to the planes defined by the upstanding flaps 20, 22. As perhaps most clearly seen in FIG. 1, the lower interior portion of each of the support arms 34, 36 may be beveled as shown at 39. Beveling the support arms 34, 36 reduces the risk of perforating the reinforcing flaps 20, 22. Also, as best seen in FIG. 1, a flap folding shoulder 35, 37 is secured, for example by welding, to the end of each of the arms 34, 36. Advantageously, the flap folding shoulders may be constructed from angle iron stock, as shown in FIG. 1. As shown in FIG. 1, in accordance with the preferred embodiment of my invention, each of the folding shoulders 35, 37 is outwardly spaced from its associated folding arm 34, 36. To provide such spacing, spacer blocks 38 are provided and are interposed between each arm and the associated folding shoulder.

Figure 3:
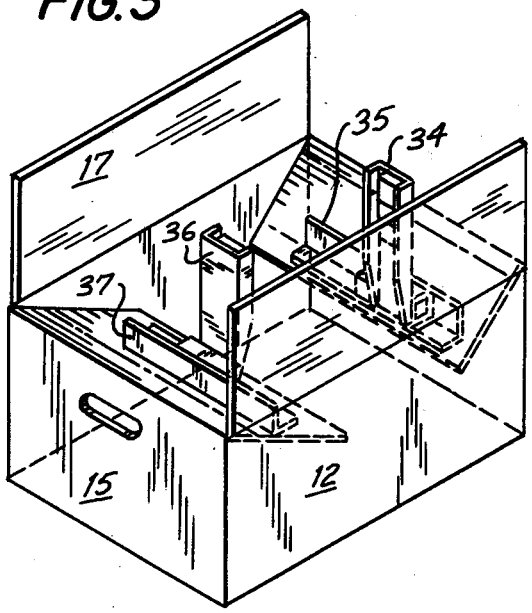
Figure 4:
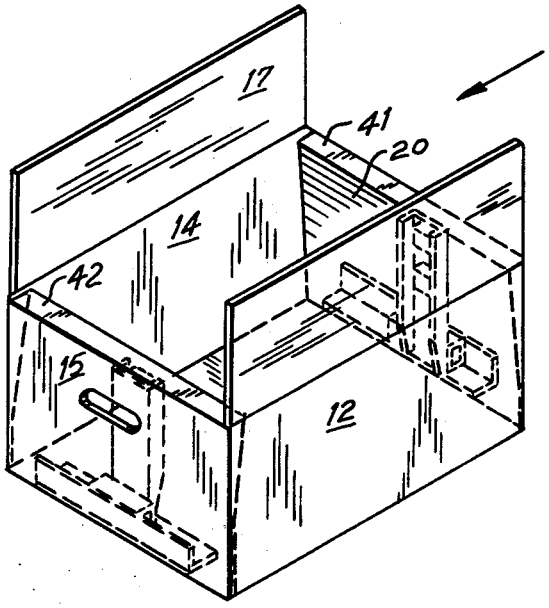
Figure 5:
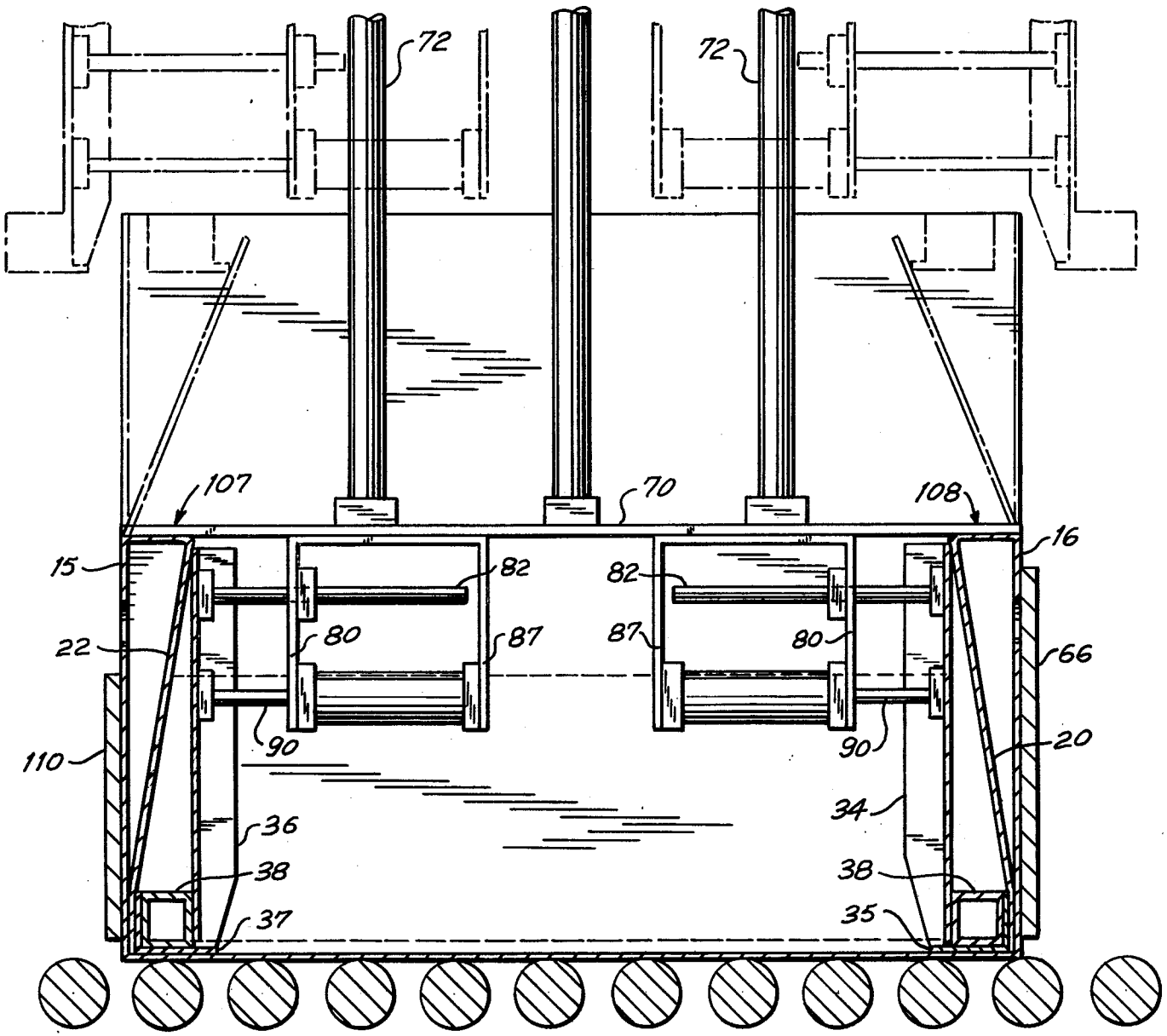

After the application of inwardly directed forces as discussed above and as shown in FIG. 2, substantially vertically directed forces are applied to the reinforcing flaps 20, 22, as shown in FIG. 3. Advantageously, such forces may be applied by driving the flap folding shoulders 35, 37 downwardly. At the end of the downward movement of the shoulders 35, 37, the flap forming shoulders are then driven outwardly as shown in FIGS. 4 and 5. By this mechanism, outwardly directed forces are applied to the lower portion of the reinforcing flaps 20, 22 and, thereby, said lower portions of the reinforcing flaps are juxtaposed against the respective side walls 13, 15. Thus, by virtue of the adhesive which had earlier been deposited on the interior side of the reinforcing flaps 20, 22, the reinforcing flaps may be secured to the side walls 13, 15.

Considering further the carton construction shown in FIGS. 4 and 5, it will be seen that when the flap folding shoulders 35, 37 are moved outwardly, the reinforcing flaps 20, 22 slope downwardly and outwardly from each other, i.e., the flaps 20, 22 are anticlinally disposed. In addition, it will be seen that substantially horizontal panels 41, 42 connect the upper edge of respective pairs of walls and flaps 13, 20 and 15, 22, respectively.

In the process of my invention, the flap forming shoulders 35, 37 are maintained in an outwardly extended position, as shown in FIGS. 4 and 5, for a period of time sufficient to allow the adhesive to form a bond connecting the reinforcing flaps to the respectively adjacent side walls. Thereupon, the flap folding shoulders 35, 37 are moved inwardly toward each other, and are then moved vertically so as to withdraw from the box.

Figure 6:
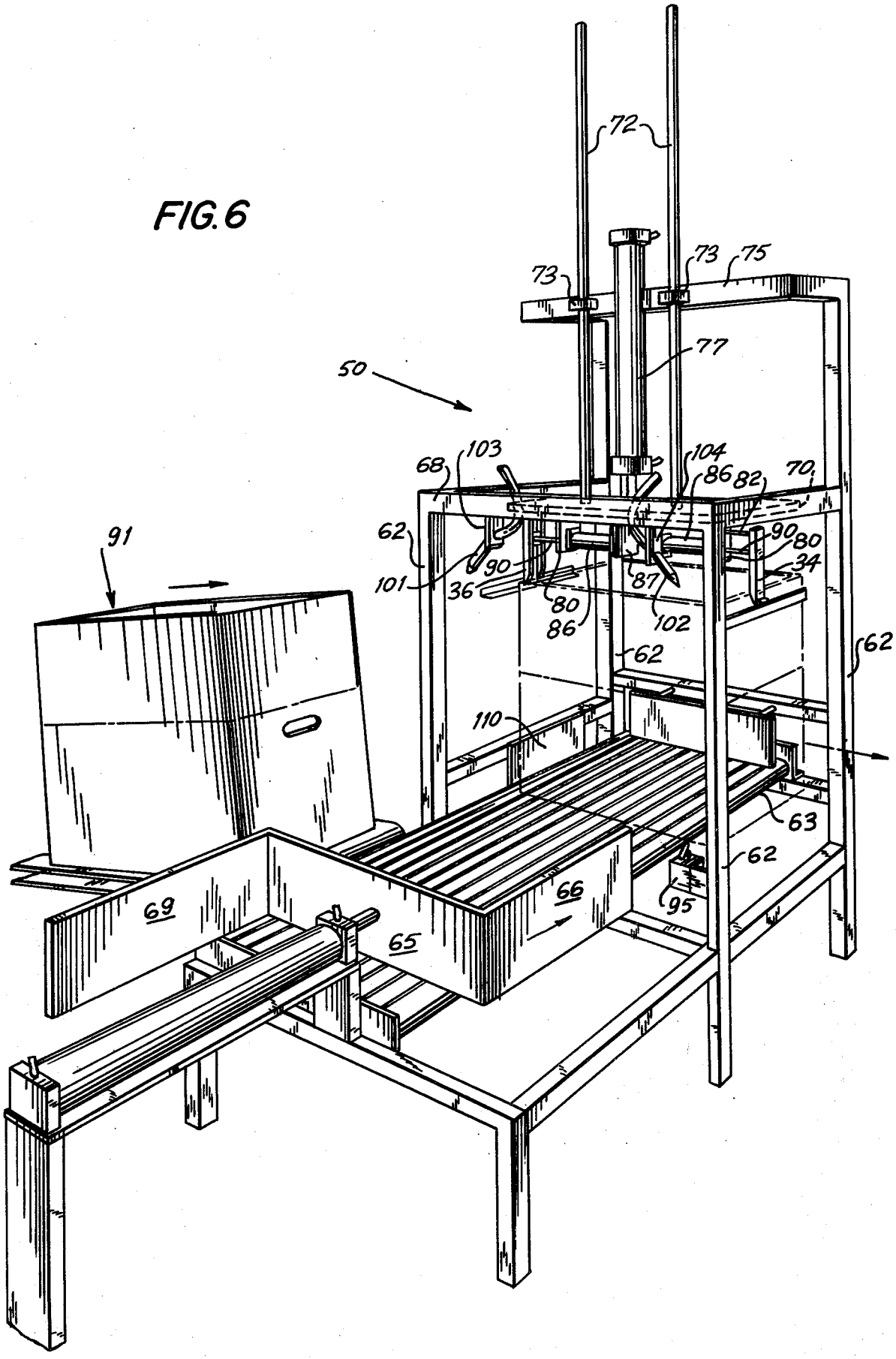
FIG. 6 is a perspective view of a preferred embodiment of my invention.

Referring to FIG. 6 there is shown a perspective view of a preferred apparatus embodiment of my invention. The machine 50 shown in FIG. 6 is comprised of a frame having a plurality of support members. The vertical support members 62 generally define a forming station. Mounted longitudinally of the machine are plurality of rollers 63 which are rotated in a clockwise direction, as shown in FIG. 6, by a motor or other conventional means, not shown. At the end of the machine distant from the forming station, there is a so called Z bar 65 which is reciprocally mounted on the machine and associated therewith, is a piston and cylinder for reciprocating the Z bar. As suggested by the representation in FIG. 6, a box having upstanding flaps may be introduced into the machine, adjacent to the retracted Z bar. The forward end 66 of the Z bar 65 functions to retain the box on the rotating rollers 63.

Returning to the forming station defined by the upstanding members 62, a mandrel 70 is mounted on the frame of the machine for vertical, reciprocable movement. Extending upwardly from the mandrel 70 are a pair of guide rods 72. The guide rods 72 are slidably received in bushings 73 which are fixedly secured to the frame members 75. Also fixedly secured to the frame of the machine is the cylinder 77, having a piston extending downwardly therefrom and the end of which is secured to the mandrel 70.

Extending downwardly from the under surface of the mandrel 70 are a pair of vertically disposed support plates 80. As seen in FIG. 6, the folding arms 34, 36 are disposed below and outwardly of the mandrel 70. A guide rod 82 extends inwardly from each of the folding arms 34, 36. Each of the guide rods 82 is slidably received in an appropriate bushing mounted on each support plate 80. Additionally, a pair of cylinders 86 are provided and are fixedly secured with respect to the mandrel 70, for example, by being sandwiched between one of the support plates 80 an appropriate bracket 87. Extending outwardly from each of the cylinders 86 is a piston 90, the free end of which is secured to a respective one of the folding arms 34, 36.

Thus, it will be seen that folding arms 34, 36 and the flap folding shoulders 35, 37 which are secured thereto, are transversely movable along a horizontal path within the forming station, i.e., by actuating the cylinders 86 the support arms 34, 36 and the associated shoulders 35, 37 may be moved from the outward position as shown in FIG. 1, to the contracted position shown in FIGS. 2 and 3. Additionally, since the folding arms and the shoulders are mounted on the vertically movable mandrel 70, it will be seen that the folding arms and the flap folding shoulders are also vertically movable in response to vertical movement of the mandrel 70, which occurs in response actuation of the cylinder 77.

In view of the foregoing description of the machine components shown in FIG. 6, the operation of this machine may now be understood. thus, a box may be fed into the machine at the end thereof distant from the forming station, as indicated by the representation 91 in FIG. 6. A box may be delivered to the machine by, for example, a conveyor belt which deposits the box on to the rotating rollers 63. After being deposited on the rollers 63, transverse movement of the box is restrained by the forward extension 66 of the Z bar 65. A photocell or microswitch or other conventional signal generating means may be supplied to detect the presence of a box, in a position against the Z bar. When the presence of a box has thus been detected, the cylinder associated with the Z bar is actuated, thereby driving the Z bar and a box forward and positioning the box in the forming station. During forward movement of the Z bar, it may again be observed that transverse movement of the box is restrained by the forward end 66 of the Z bar.

As the box passes the intermediate support members 62, a microswitch or photo-cell 95 detects this event. In response to a signal generated by the switch 95, hot melt glue guns 101 and 102 are actuated. As shown in FIG. 6, the glue guns 101 and 102 are mounted on brackets 103, 104 which are secured to the support member 68. Additionally, as may be seen in FIG. 6, the glue guns 101 and 102 are aimed downwardly and outwardly. Thus, when the glue guns are actuated by the closure of a contact in switch 95, a box passing by the glue guns will have a hot melt adhesive deposited on the interior surface of the upwardly extending flaps, adjacent to their terminal edge. When the box has thus been positioned within a forming station, the glue guns are automatically de-activated by the opening of a contact in switch 95.

Upon the arrival of a box in the forming station, forward movment of the Z bar stops and the Z bar temporarily remains in an extended position. A rearwardly extending portion 69 of the Z bar 65 prevents other boxes from being introduced into the machine.

At this point in the sequence, the folding arms and folding shoulders are disposed with respect to the upwardly extending flaps, as shown in FIG. 1 of the drawings, i.e., outwardly of the upstanding flaps. Thereupon, in response to a signal from appropriate and conventional control means, the cylinders 86 are actuated and, thereby, the folding arms and folding shoulders are driven inwardly. As a result, inwardly directed forces are applied to the upstanding reinforcing flaps and the reinforcing flaps are folded toward each other. At the end of the inward movement of the folding arms 34, 36, the folding arms will be in a position, with respect to the box, as shown in FIG. 2. Thereupon, the cylinder 77 is actuated thereby driving downwardly the mandrel 70 and the folding arms and shoulders to the position shown in FIG. 3 of the drawings, whereby the reinforcing flaps 20, 22 are positioned substantially within the box and the terminal edges of the reinforcing flaps are adjacent to the box. When downward movement of the mandrel stops, the cylinders 86 are actuated so as to drive the flap folding shoulders 34, 36 outwardly, thereby positioning the lower portion of the reinforcing flaps against the side walls 13, 15. Thus, the configuration shown in FIG. 5 is achieved wherein it will be seen that the lower portions of the reinforcing flaps have been bent on the score lines 28, 30 and these portions are pressed against the adjacent vertical side walls 13, 15. Additionally, at the top surface of the box, the reinforcing flaps 20, 22 bend about the score lines 24, 26 so as to define substantially, horizontally disposed shoulder panels 41, 42. To facilitate the correct formation of the shoulder panels 41, 42, the mandrel 70 may be extended as shown at 107, 108 so as to provide bearing surfaces which bear against the top surface of the shoulder panels 41, 42. In other words, the bearing surfaces supplied by the extensions of the mandrel cooperate with the flap folding shoulders 35, 37 to insure the correct formation of the anticlinially disposed reinforcing panels 20, 22.

Returning to FIG. 6, it may be ndoted that when a box is positioned in the forming station, a fixedly mounted plate 110 is provided to bear against one of the side walls of the box in the forming station and the other side panel of such a box would be abuting against the forward extension 66 of the Z bar. Thus, it will be seen that the flap folding shoulders 35, 37 press respective pairs of the reinforcing panels and side wall panels against either the plate 110 or the Z bar extension 66, thereby insuring that the outward forces exerted on the box by the cylinders 86 do not deform the box. Thus, the plate 110 and the Z bar extension provide back-up means to resist the forces applied by the flap forming shoulders.

The cylinders 79 are maintained in an actuated state for a period of time sufficient to insure that the adhesive deposited on te reinforcing flaps has formed a secure bond between the reinforcing flaps and the adjacent side walls of the box. Thereafter, the cylinders 86 are reverse actuated to contract the flap folding shoulders. Thereupon, the cylinder 77 is reverse actuated so as to withdraw the mandrel 70 and the folding arms and flap shoulders associated therewith. After the mandrel is fully retracted, the cylinders 86 are again actuated to position the folding arms and flap shoulders outwardly of the mandrel in preparation for receiving the next box. Substantially simultaneously therewith, the Z bar is withdrawn to the other end of the machine. Upon withdrawal of the Z bar the forward extension thereof is no longer present to restrain the box from transverse movement imparted thereto by the plurality of rotating rollers. As a result the box is automatically, transversely discharged from the machine.

As indicated earlier, control of the various operations performed by the machine shown in FIG. 6 may be realized by employing any conventional programing or sequencing means known to those skilled in the art to which this invention pertains. For example, a plurality of cam operated, motor driven microswitches may be used.

Although a preferred embodiment of my invention as hereinbefore been described, it will be appreciated that others skilled in the art to which this invention pertains may perceive other embodiments of my invention, without departing from the scope of my invention as defined by the claims appended hereto.

I claim:

1. The process of folding into a box a pair of flaps which extend upwardly from opposite side walls of said box, said process comprising:

a. applying to the outer surface of each of said flaps a substantially horizontal, inwardly directed force;

b. applying to the outer surface of each of said flaps a substantially vertical downwardly directed force; and c. applying to the surface of each of said flaps a substantially, outwardly directed force after the application of said substantially vertically directed force.

2. The process of forming a box wherein at least two opposite walls are comprised of two plies, each of said walls having an outer vertical ply and an inner ply which extends downwardly and outwardly and is secured to the adjacent outer ply, each outer and inner ply being connected at the top of the box by a substantially horizontal panel, said process comprising:

a. supplying a open top box having flaps extending upwardly from opposite walls;

b. rotating each of said flaps inwardly and through an angle greater than 180°;

c. pressing outwardly against each of said flaps at a point adjacent to the terminal edge of said flaps; and d. pressing a flat bearing surface agaist each of said substantially horizontal panels.

3. The process of claim 2 which further comprises the step of depositing an adhesive material on the inner surface of each of said flaps, adjacent the terminal edge of said flaps prior to rotating each of said flaps.

4. The process of cliam 3 which further comprises providing a backing plate bearing against the outer surface of each of said outer plies when pressing outwardly against each of said flaps.

5. An apparatus for forming a box having double ply side walls wherein the interior plies of said side walls are anticlinally disposed, and the upper edges of respective pairs of said plies are connected by a substantially horizontal panel, and the lowermost portion of each interior ply is secured to the adjacent exterior side wall, said apparatus comprising:

a. a forming station;

means for positioning within said forming station an open top box having flaps extending upwardly from opposite side walls;

c. folding means, movably mounted within said forming station for movement along a path which is perpendicular to said upwardly extending flaps and along a path which is perpendicular to the bottom of said box.

6. The apparatus of claim 5 which further comprises means for depositing an adhesive on each of said flaps, adjacent the terminal edge thereof, when said box is being positioned within said forming station.

7. The apparatus of claim 6 wherein said folding means comprises:

a. a vertically movable mandrel;

b. folding arms mounted on said mandrel and movable, with respect to said mandrel, along a substantially horizontal path; and, c. a flap folding shoulder secured to each of said folding arms.

8. The apparatus of claim 7 wherein the size and downward movement of said mandrel is adjusted so that a portion of the bottom surface of said mandrel contacts said substantially horizontal panels at the end of the downward movement of said mandrel.

9. An apparatus for folding flaps which extend generally upwardly from opposite sides of an open top box, said apparatus comprising:

a. a forming station;

b. means for feeding formed, open top boxes, having upstanding flaps, one at time, along a longitudinal path into said forming station;

c. means for depositing an adhesive on the interior of said upstanding flaps, adjacent the terminal edges thereof, as each box is fed to said forming station;

d. said forming station including;

i. a vertically movable mandrel; and ii. folding means movably mounted on said mandrel and acting in timed relation with said mandrel for folding said flaps inwardly before said mandrel moves downwardly and then downwardly when said mandrel moves downwardly.

10. The apparatus of claim 9 which further includes means for discharging from said forming station a box with folded flaps.

11. The apparatus of claim 10 wherein said folding means comprises folding means operatively associated with said mandrel for applying inwardly directed forces to said flaps before said mandrel moves downwardly and then applying outwardly directed forces on said flaps after said mandrel has moved downwardly.

12. The apparatus of claim 9 wherein said folding means are actuated by pistons and cylinders.

13. The apparatus of claim 9 wherein said folding means comprises:

a. a pair of folding arms extending downwardly from said mandrel and movably mounted on said mandrel for movement along a path perpindicular to the path of movement of said mandrel.

14. The apparatus of claim 10 wherein said discharge means comprises a plurality of longitudinally disposed rollers and means for rotating said roller so as to discharge a box.

* * * * *

UNITED STATES PATENT AND TRADEMARK OFFICE

CERTIFICATE OF CORRECTION

PATENT NO. : 4,022,116

DATED : May 10, 1977

INVENTOR(S) : Robert H. Frappier

It is certified that error appears in the above-identified patent and that said Letters Patent are hereby corrected as shown below:

Column 1, Line 6, "caled" should be "called";

Column 1, Line 24, "diclosed" should be "disclosed";

Column 1, Line 39, "relection" should be "reflection";

Column 1, Line 47, "wich" should be "which";

Column 2, Line 28, "lonitudinally" should be "longitudinally";

Column 4, Line 64, "thus" should be "Thus";

Column 5, Line 53, after the word "the" insert "bottom of the";

Column 6, Line 6, "ndoted" should be "noted";

Column 6, Line 22, "te" should be "the";

Column 7, Line 11, "agaist" should be "against";

Column 7, Line 17, "cliam" should be "claim"; and

UNITED STATES PATENT OFFICE
CERTIFICATE OF CORRECTION

Patent No. 4,022,116 Dated May 10, 1977

Inventor(s) Robert H. Frappier

It is certified that error appears in the above-identified patent and that said Letters Patent are hereby corrected as shown below:

Column 7, line 29, before the word "means" insert "b.".

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*